United States Patent [19]

Rahikka

[11] 4,191,132

[45] Mar. 4, 1980

[54] THERMIC REACTOR

[76] Inventor: Veikko E. Rahikka, Kaksostentie 5A 73, Helsinki, Finland

[21] Appl. No.: 855,543

[22] Filed: Nov. 29, 1977

[51] Int. Cl.[2] ..... F22B 13/02

[52] U.S. Cl. ..... 122/156; 431/173; 122/155 C

[58] Field of Search ..... 122/34, 155 C, 136 C; 431/173, 156

[56] References Cited

U.S. PATENT DOCUMENTS

| | | | |
|---|---|---|---|
| 931,422 | 8/1909 | Henzel | 122/155 |
| 1,438,260 | 12/1922 | Pilcher | 122/155 |
| 2,040,090 | 5/1936 | Holzwarth | 122/24 |
| 2,503,883 | 4/1950 | Miller | 122/136 |
| 2,808,012 | 10/1957 | Schindler | 431/173 |
| 3,759,230 | 9/1973 | Cooksley | 122/155 |

*Primary Examiner*—Edward G. Favors
*Attorney, Agent, or Firm*—J. Harold Nissen

[57] ABSTRACT

A thermic reactor having plural V-shaped chambers wherein hot exhaust gases are caused to flow turbulently through the chambers in a manner to ensure good heat transfer between the exhaust gases and the walls of the thermic reactor.

5 Claims, 7 Drawing Figures

THERMIC REACTOR

The object of the invention is a thermic reactor functioning on the principle of the so called turbulence combustion in a combustion chamber combined with chambers having their naves flattened and fitted with center openings and also tangential channels, the chambers having walls, which are V-shaped serving as steering surfaces for the gases, thus due to low or high pressure in each chamber or in combined chambers, a turbulence alternately reducing or distending will be formed.

A method of setting outlet gases in a quick rotary motion is previously known. However an effective thermal absorption of heat and its convection has not found its solution for a boiler construction or a whole unit as such based on a turbulent motion.

The purpose of this invention is to further develop and improve the heating system of a thermic reactor having effective fire surfaces and the best possible combustion. The characteristic features are mentioned in the Patent Claims.

The effective turbulent motion of the gases and their continuous touch at the surfaces of the combustion chamber walls are conditions for the best combustion for reactor not getting sooty. According to the invention it is possible to group together similar chambers, which will improve the manufacturing in series.

Figure 1:
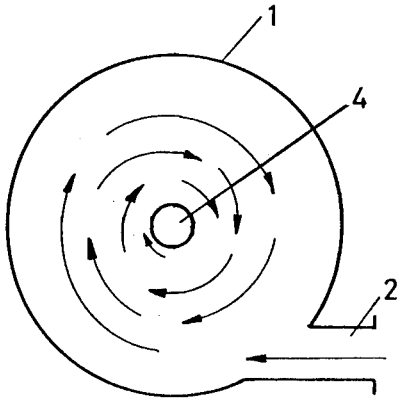

Some features of the invention are illustrated by examples in the following enclosed drawings:

FIG. 1 is a schematic drawing of the combustion chamber

Figure 2:
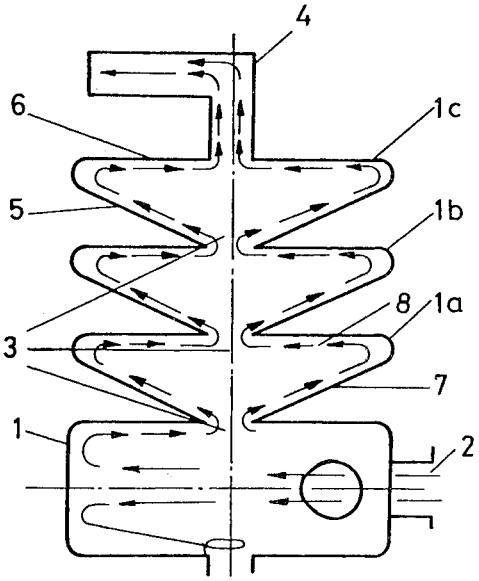
Figure 3:
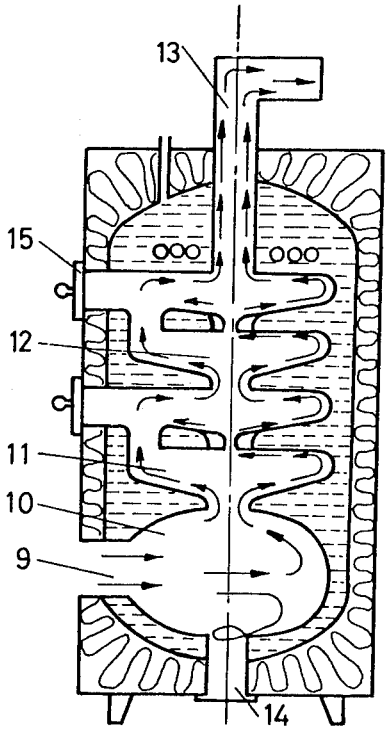
Figure 4:
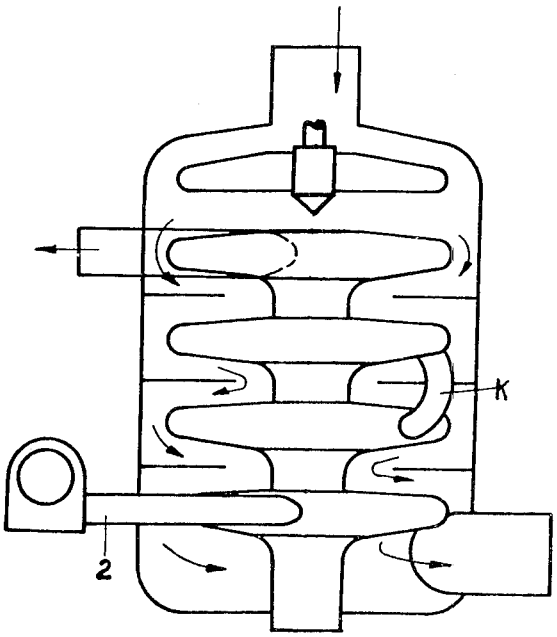
Figure 7:
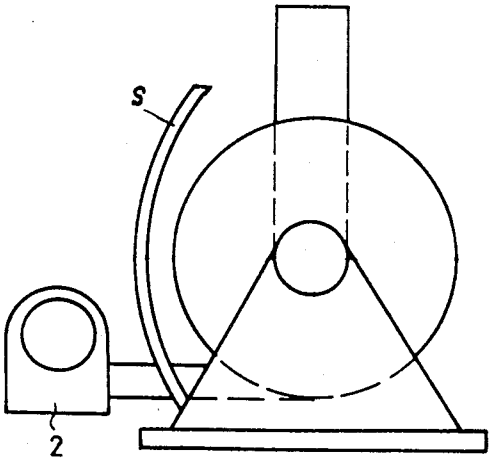
Figure 5:
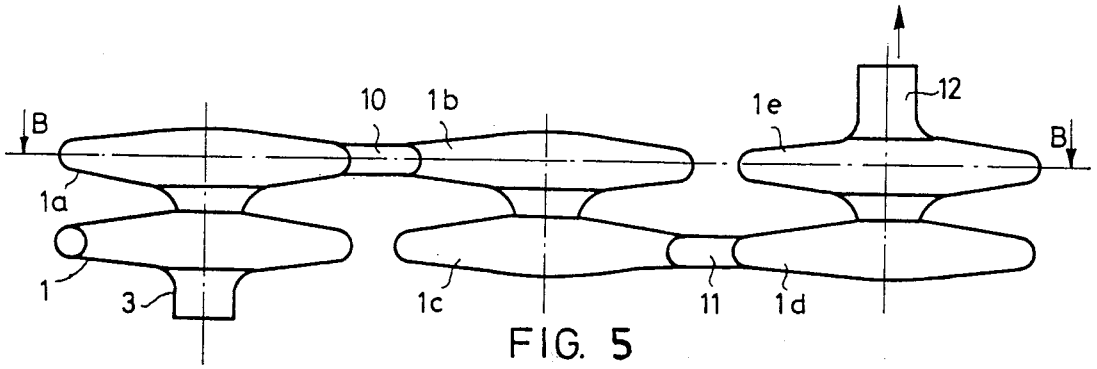
Figure 6:
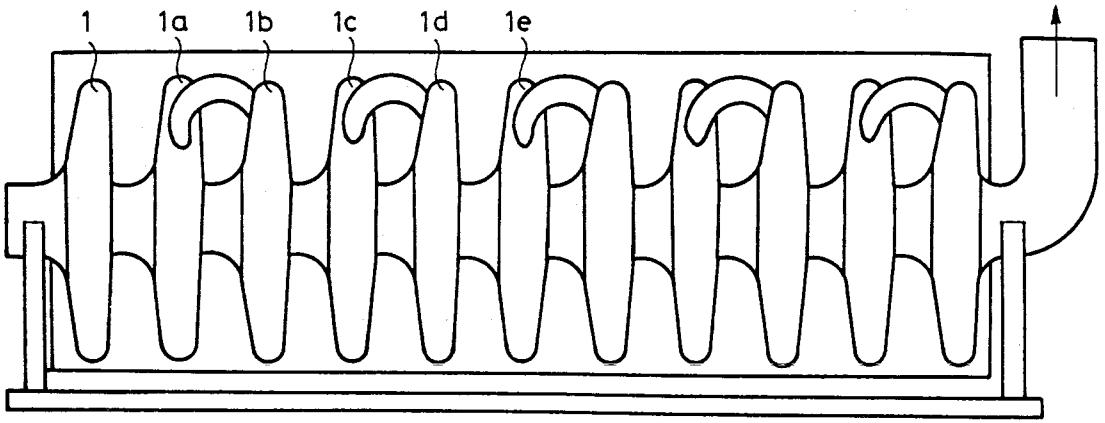

FIG. 2 is a schematic drawing of the method of actions for the V-shaped chambers in accordance with the invention FIG. 3 is a vertical section of a boiler furnace FIG. 4 illustrates another kind of reactor with an adopted heat exchanger FIG. 5 illustrates the combustion chambers coupled in pairs FIG. 6 illustrates the combustion chambers in a row FIG. 7 illustrates the reactor seen from one end, according to the drawing in FIG. 6.

FIG. 1 and 2 are schematic drawings of the flow of fuel and gases into the combustion chamber 1 from the tangentially placed opening 2. From the chamber 1 in FIG. 2 the flow continoues towards the center 3 into one or several chambers 1*a*, 1*b*, 1*c*, caused by natural air draught or that is pressed by pressure. The V-shaped walls of the chamber are 5 and 6 and they cause two different turbulences 7 and 8 along their steering surfaces. In relation to the center line of the chamber the wall 5 is situated outwards and the wall 6 is directed inwards.

The FIG. 3 illustrates an adoption of the invention, a reactor functioning as a boiler furnace. The fuel/air mixture is led from the opening 9 into chamber 10 and further to chambers 11 and 12 and the smoke flows through the smoke channel 13. Thus the gas turbulence makes the water which surrounds the combustion chamber in rotation in the same direction and a troublesome boiling will be avoided. The FIG. 3 shows still the ash hole 14 and the soot-holes 15.

When two different turbulences are formed in this way in each chamber, alternately reducing and distending, the burning will be as effective as possible because the turbulences will be mixed up by each other when the cases flow from centre to next chamber and/or through the tangentially connected channel. The steering surfaces being wavy- or spiral-like makes the burning more effective. The steering surfaces may have raylike netchannel formation serving the small possible turbulences. In accordance to the invention the reactor can be adopted to function by natural air draught using wood, wood remains and peat.

The FIG. 4 illustrates an adaption of the invention, where the reactor serves as a heat exchanger to produce hot air and for instance for air conditioning. In the same FIG. the center chambers are connected by channel k tangentially having the connected chamber throttled in the center opening.

The FIG. 5 illustrates one adaption of the invention, where the combustion chambers can be coupled in pairs also tangentially beside each other. Thus here the chambers 1 and 1*a* are coupled in the same center, whereas the chambers 1*b* and 1*c* are placed beside them so, that the chambers 1*a* and 1*b* are tangentially connected with each other by channel 10. Further there is a third couple of turbulence chambers 1*d* and 1*e* which are tangentially coupled with channel 11. Also in this chamber unit the gas turbulence continues from chamber to chamber, alternately reducing and distending, until the gas flow out from the last chamber through the channel 12, after the combustion has been complete and the gases have heated the intermediate medium. Burners can naturally also in this adaption be placed in several chambers. In accordance with FIG. 6 and 7 a burner device functions as a heat radiator, as a so called infrared radiator, which is very suitable in the building industry, halls etc.

In this device the same chambers 1, 1*a*, 1*b*, 1*c* etc. are in line one after another, coupled together or pressed out in one unit. The chambers are fitted together by turns in the middle and by turns tangentially from the periphery.

The FIG. 7 illustrates the reactor drawing in FIG. 6 seen from the end and where the oil burner 2 is coupled to the device. The device is meant to be placed in a horizontal position and behind it is placed a concave reflector S, the purpose of which is to direct the radiation on a specified object. Using this invention it is possible to make as effective and long heat radiators as desired. Naturally the construction can also be vertical.

The invention can be adopted to many other forms and constructions within the patent application limits. Instead of separate chambers the same chambers may be pressed out of tube-like walls as a whole unit or as parts combined in groups.

What I claim is:

1. A thermic reactor utilizing turbulent flow to ensure good heat transfer between hot exhaust gases from a combustion chamber, and the walls of the thermic reactor, comprising a plurality of V-shaped chambers in serial communication with each other;

a first said chamber having a first chamber inlet for receiving hot gases; a tangentially located first chamber outlet, and a centrally located first chamber outlet;

a second said chamber having a centrally located second chamber inlet and a tangentially located second chamber inlet, said second chamber central inlet being in communication with said centrally located first chamber outlet and being disposed at an opposite end of said said second chamber, from said second chamber outlet; and a tangential conduit communicating said first chamber tangential outlet with said second chamber tangential inlet, to form two gas flow paths through said chambers, one path expanding and contracting in size as the gas passes from said first chamber to said second chamber through said central inlet and outlet, and a second path generally spiraling through said tangential conduit, said paths including combined intersecting and countercurrent flow patterns with respect to each other thereby to produce enhanced turbulent flow patterns in gas flow through said thermic reactor.

2. The thermic reactor of claim 1 wherein each V-shaped chamber comprises lower walls and upper cap-walls the lower walls of each V-shaped chamber extend outwardly and upwardly to form a V-shaped expanding path for the gases; and the upper cap-walls of each chamber extending inwardly and slightly upwardly to each said respective chamber outlet to form a contracting path for the gases.

3. The thermic reactor of claim 1 wherein there are an even number of said V-shaped chambers, pairs of said chambers being coupled together in tandem and tangentially coupled to adjacent pairs of said chambers.

4. The thermic reactor of claim 1 wherein said chambers have a ray-like netchannel combination for the small turbulences.

5. The thermic reactor of claim 1 further comprising a third said chamber;

said third chamber having only one inlet, a centrally located inlet communicating with said second chamber centrally located outlet, to cause all the gas flowing into said second chamber through both said second chamber inlets to enter said third chamber through said centrally located inlet thereby mixing gas following both said first and second flow paths.

* * * * *

UNITED STATES PATENT AND TRADEMARK OFFICE

CERTIFICATE OF CORRECTION

PATENT NO. : 4,191,132

DATED : March 4, 1980

INVENTOR(S) : Veikko Eino Rahikka

It is certified that error appears in the above-identified patent and that said Letters Patent are hereby corrected as shown below:

Column 1, Line 68 change "cases" to --gases--

Column 2, Line 67 delete "said" first occurrence

Signed and Sealed this

*Twenty-third* Day of *September 1980*

[SEAL]

*Attest:*

SIDNEY A. DIAMOND

*Attesting Officer*

*Commissioner of Patents and Trademarks*